United States Patent [19]

Maidment et al.

[11] 4,188,970

[45] Feb. 19, 1980

[54] APPARATUS FOR CONTROLLABLY INJECTING CONTAMINANT MATERIAL INTO A LIQUID FLOW SYSTEM

[76] Inventors: Peter E. Maidment, #301-155 Toronto Rd., Port Hope, Ontario; Marcel Thouin, 334 de Cétoile, H774T9, Laval, Quebec, both of Canada

[21] Appl. No.: 910,729

[22] Filed: May 30, 1978

[30] Foreign Application Priority Data

May 31, 1977 [CA] Canada ..... 279489

[51] Int. Cl.[2] ..... F17D 1/00

[52] U.S. Cl. ..... 137/268; 137/604; 251/145

[58] Field of Search ..... 137/268, 604, 605; 251/144, 145; 422/255

[56] References Cited

U.S. PATENT DOCUMENTS

| | | | |
|---|---|---|---|
| 1,221,851 | 4/1917 | Etienne | 137/268 X |
| 1,548,363 | 8/1925 | Hurst | 137/605 X |
| 3,240,230 | 3/1966 | Callahan | 137/605 X |
| 3,472,285 | 10/1969 | Ginsburgh | 137/268 X |
| 3,716,346 | 2/1973 | Greene | 137/605 X |

*Primary Examiner*—Alan Cohan

*Attorney, Agent, or Firm*—Nathan Edelberg; Robert P. Gibson

[57] ABSTRACT

This apparatus is primarily intended for use in injecting selected quantities of solid fine contaminant particles into a liquid flow system having a filter, separator, coalescer or the like therein to determine the performance of the same in removing the contaminants from the liquid. The apparatus, however, may be used to inject other contaminant materials, not necessarily solid fine particles, into a flowing liquid.

9 Claims, 12 Drawing Figures

APPARATUS FOR CONTROLLABLY INJECTING CONTAMINANT MATERIAL INTO A LIQUID FLOW SYSTEM

DEDICATORY CLAUSE

The invention described herein may be manufactured, used, and licensed by or for the United States Government for governmental purposes without the payment to us of any royalties thereon.

BACKGROUND OF THE INVENTION

This invention relates to an apparatus for use in controllably injecting contaminants into a liquid flowing in a system.

The nature and concentration of contaminants found in service are infinite and therefore to provide a common and representative base for evaluating cleaning devices, artificial contaminants or test dust of a known and fixed composition are employed. The contaminant removal efficiency of the cleaning devices may then be determined by introducting, into the liquid flow, artificial contaminants in prescribed concentrations. This requires an apparatus which will inject the artificial contaminant in controlled amounts and, at the same time, achieve complete dispersion of the contaminant in the flowing liquid.

There are specifications available which outline test procedures for evaluating cleaning devices including the type of test dust and contaminant injection rate to employ. There are a number of existing techniques used to introduce a contaminant, such as powder, into a liquid which include mechanical, ultrasonic or mechanical spreader mixing followed by forced injection of the contaminant into the liquid. In mechanical mixing, solid particles are mixed with a liquid in a reservoir using a rotor resulting in a slurry which is then forced into the liquid stream of a test system by way of a pump. In ultrasonic mixing the rotor is replaced by an ultrasonic agitator. The mechanical spreader technique consists of dropping the solid particles onto a variable speed driven belt where they are then evenly spread. The particles are then dumped into a reservoir and mechanically mixed as a slurry which is pumped into the liquid stream. Another technique is referred to as air entrainment in which the solid particles are entrained and conveyed to the point of injection by air. The dust cloud is then bubbled through the liquid. In what is known as erosion and turbulent mixing, the flowing liquid erodes away that part of the test dust which is in contact with the liquid. If the liquid has enough turbulence, the eroded chunks are broken away and a reasonably homogeneous mixture may be obtained.

There are limitations in using the foregoing techniques. For example, in mechanical mixing followed by forced injection, although control over the injection may be relatively good, it is difficult to determine the exact quantity injected in most cases. Also the solid particles enter the liquid as a slurry and not in a fully dispersed state. Furthermore, the apparatus must be cleaned to ensure contamination build up does not occur in the injection system, affecting the performance of the device. Generally, the mechanical equipment must be fairly complex to provide the desired operation.

With ultrasonic mixing and forced injection, what is stated above with respect to the drawbacks of mechanical mixing also applies and there is an additional problem in that ultrasonic agitation is normally not sufficient to keep the heavy particles of contaminants in suspension. Mechanical spreader and forced injection systems require relatively complex mechanical equipment and also the contaminant enters the liquid stream as a slurry and it is difficult to determine the exact quantity injected. In the case of air entrainment, the contaminant must be in the form of a dry powder and as a result there is a tendency for the larger and heavier contaminant particles to be entrained last. Also, deposits of contaminant build up at the point of injection because the liquid stream dampens the dust causing it to coalesce and deposit there. With erosion and turbulent mixing, although the contaminant enters the liquid stream in a well dispersed manner, the injection rate is very difficult to regulate. The rate fluctuates markedly during any single injection and is virtually impossible to repeat.

For effective comparison in the performance of cleaning devices and also to reasonably predict their performance in service, the artificial contaminant should be representative of the contaminant in size, distribution, density and shape factor found in service. The rate of which the contaminant is fed into the test circuit should be completely controlled and the test dust should enter the flowing liquid in a finely divided and dispersed state.

A principal object of the present invention is to provide an injection apparatus that will accomplish the foregoing which has the capability of introducing both large and small quantities of contaminant materials.

A further principal object of the present invention is to provide an injection apparatus that is simple in operation, easy to install in a test system and yet have no effect on the performance of the cleaning device being tested.

It is a further object of the present invention to provide an injection apparatus which is as self-contained as possible and requires minimum capital, operating and maintenance costs.

SUMMARY OF THE INVENTION

The present proposal is based on the concept of utilizing turbulent mixing at the point of injection of the contaminant material into the liquid stream resulting in substantially complete dispersion of the contaminant in the liquid stream. In addition, air under pressure is employed to control the rate of injection and to maintain a substantially uniform dispersion of the contaminant before injection.

The apparatus, in general, comprises an upper section having a reservoir where a liquid and contaminant particles are premixed by compressed air to form a slurry and a lower section in which the actual injection takes place. The lower section is designed to maximize the turbulence at the point of injection. Optionally, a center section is provided for insertion between the upper and lower sections and which is normally used only for low and medium concentration injections. The function of the intermediate section is to decrease the concentration of the slurry and aid in the dispersion process before injection.

In keeping with the foregoing, there is particularly provided in accordance with the present invention an apparatus for use in controllably injecting contaminant material into a liquid flowing through a conduit in a liquid flow system, said apparatus comprising a body member having a first fluid flow passage therethrough adapted to be connected in series with said conduit, a second fluid flow passage in said body having a restricted discharge outlet opening into said first fluid flow passage, an adjustable valve for varying the rate of flow of material through said restricted discharge outlet into said first fluid flow passage, a third fluid flow passage having a discharge outlet opening into said second passage and adapted for connection to a source of pressurized fluid, a closable reservoir chamber communicating with said second passage at an end thereof opposite said restricted dicharge outlet, said reservoir having means to introduce contaminant material therein, and a pressure relief means for said reservoir chamber disposed at a position remote from where the reservoir communicates with said second passage for operation when said reservoir is in an upright position.

The invention is illustrated by way of example with reference to the accompanying drawings wherein:

DESCRIPTION OF THE PREFERRED EMBODIMENT

Figure 12:
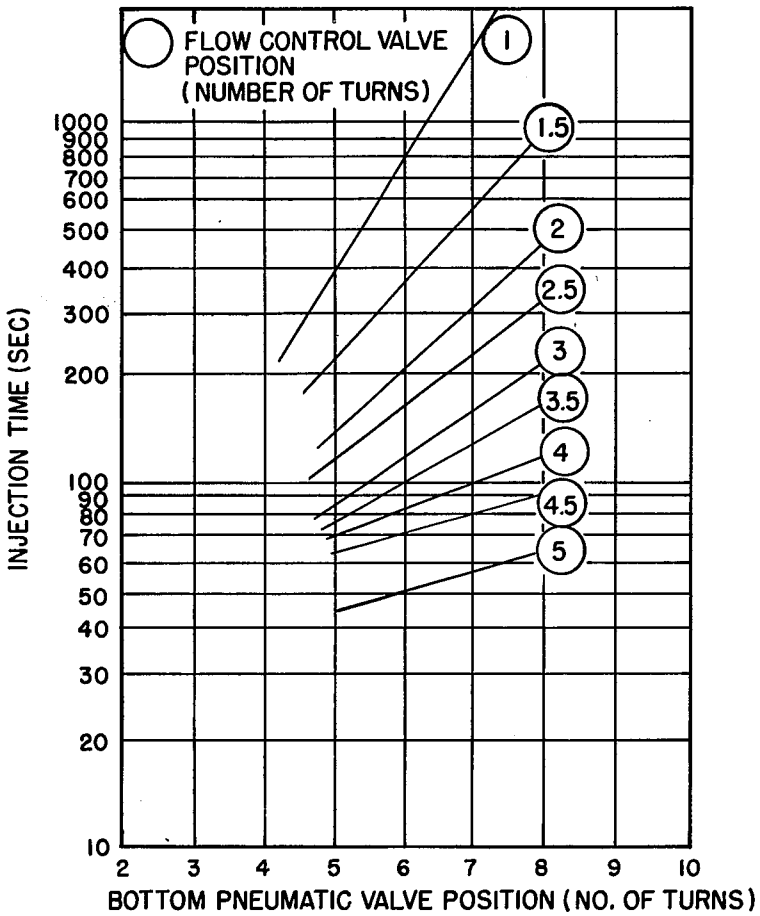
FIG. 12 is a graph illustrating calibration of the device used in conducting an actual test.

Referring to the drawings, there is illustrated an apparatus constructed in accordance with the present invention for injecting a contaminant of solid particles into fluid flowing through a line 10 which is part of a test system having, for example, a filter 20 therein to be tested for its effectiveness in removing the contaminant particles from the fluid. The apparatus, hereinafter referred to as an injector, is preferably constructed mainly of plexiglass to allow visual monitoring of the injection process. Other components of the apparatus are stainless steel or aluminum and these construction materials have been selected so as to minimize corrosion and the problems of unintentionally contaminating the system.

The injector consists of three basic subassemblies or sections, namely a reservoir section 100, a central section 200 and an injection section 300.

The reservoir section 100 consists of a graduated hollow cylinder 101 closed at one end by a screw-on cap 102 and, at the other end, is secured to a mounting block or adapter 103 which in turn is connected to the body of the central chamber by studs 104 or, alternatively, directly to the body of the injection section as will become evident hereinafter. The screw cap 102 has an air bleed valve subassembly 105 for releasing air from the reservoir to atmosphere. The valve subassembly consists of a Hoke Milli-Mite needle or equivalent valve 106, a coupling 107 and a nipple 108 threaded into an aperture in the end of the cap 102. A gasket 109 is interposed between the end of the cylinder 101 and the end wall of the cap for sealingly closing the end of the cylinder.

Figure 8:
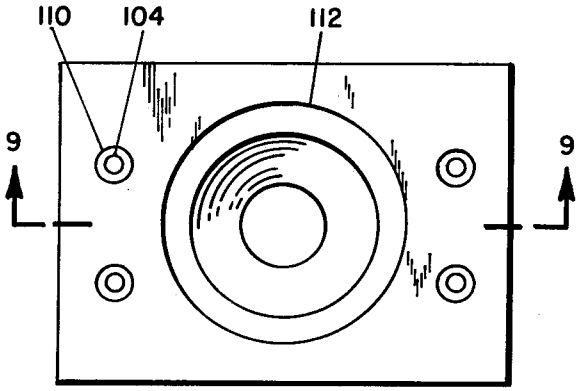
FIG. 8 is a plan view of a body member at the lower end of the reservoir of the apparatus and is taken essentially along line 8—8 of FIG. 2 but showing the whole body.
Figure 9:
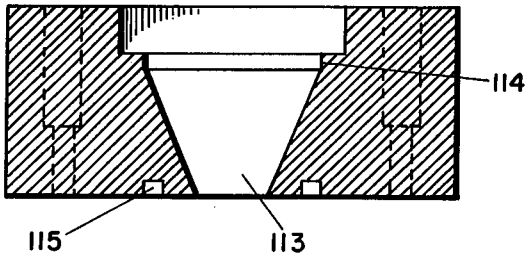
FIG. 9 is a sectional view along line 9—9 of FIG. 8.
Figure 4:
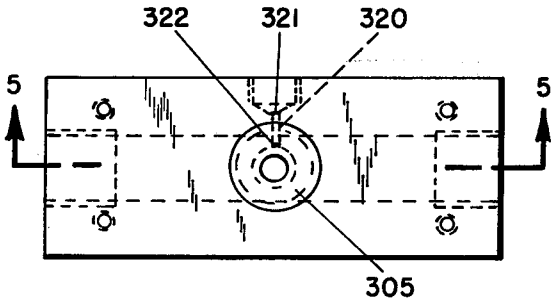
FIG. 4 is a top plan view of the body for the injection section of the apparatus taken essentially along line 4—4 of FIG. 2 but showing the whole body.
Figure 5:
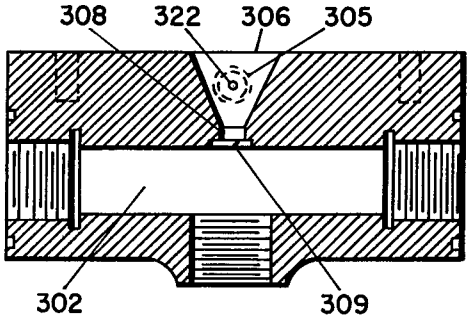
FIG. 5 is a sectional view along line 5—5 of FIG. 4.

The adapter for mounting block 103 has four apertures 110 (see FIGS. 8 and 9) for receiving studs 104 and located centrally on one face of the block is a recess 112 for receiving an end portion of the cylinder 101. Extending from the recess through the block is a truncated conically shaped passage 113 wherein the larger diameter and the entry to such passage from the reservoir corresponds to the internal diameter of the cylindrical tube 101 and the smaller diameter, remote therefrom, is less than half the size of the larger diameter. In an actual device constructed, the respective larger and smaller diameters were 2 inches and $\frac{7}{8}$ inch. The walls of the passage have a slope of approximately 22° relative to the central axis of the passage and curve, as at 114, to merge into a continuation of the inner wall of the cylinder. The face of the block disposed opposite to the one from which the cylindrical tube projects has an annular recess 115 in which there is located an O-ring seal 116.

Figure 11:
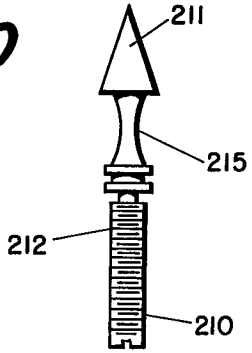
FIG. 11 is a detailed view of the flow control valve for the central section of the apparatus.

The central section 200 is optionally used, depending upon the concentration of contaminant to be injected and rate of injection required. If very high concentrations and/or fast rates of injection are required, the central chamber is omitted, in which case the adapter 103 is connected directly to the injection section by the studs 104. The central section 200 includes a body having opposed planar faces 201 and 202 disposed in abutting relation with flat planar faces on the respective adapter 103 and injection section 300. In the body there are respective first and second coaxial passages 203 and 204 disposed in end-to-end spaced apart relation. Passage 203 has a conically shaped lower end portion 205 communicating with a passage 206 which in turn communicates with a passage 207 that terminates in a side wall of passage 204. A flow control valve subassembly 208 is mounted in the body of the central section by way of a gland nut 209 which threadingly receives a stem 210 of a needle valve 211. The valve stem is threaded in the gland nut as indicated at 212 and may be readily turned by a finger grip nut 213 attached to the stem for moving the needle valve toward and away from a valve seat 214 in the passage 206, thereby permitting means to adjust flow rate through such passage. The valve stem 210 has an intermediate portion 215 that traverses the passage 207 and the walls of such valve intermediate section are concave as clearly seen from FIG. 11. The body of the central section has tapped bores 216 for receiving the studs 104 and apertures 217 for receiving studs 218 that attach the central section to the injection section 300. An O-ring seal 219 is fitted into an annular groove circumscribing the open end of passage 204 and abuts against the planar face of the injection section providing a seal around the passage which has a continuing portion in the injection section that will be described hereinafter. The body of the central section 200 has a fifth passage 220, the inlet of which is connected to an air pressure supply line 400 through an adjustable air control valve 500 and an opposite outlet end in a wall of the passage 206.

The injection section 300 includes a body 301 having a passage 302 extending therethrough and adapted for connection in line with conduits 10 by way of pipe coupling members 303 and 304. Passage 302 is disposed transversely to the longitudinal axis of passage 204 and communicates therewith by way of a passage 305 having respective inlet and outlet ends 306 and 307. The passage 305 tapers in a direction from the inlet toward the outlet end providing effectively a truncated conically shaped passage. Between the truncated cone portion of the passage and the outlet 307 there is a cylindrical passage portion 308 followed by a larger, relatively short cylindrical passage 309 that defines the outlet. An injection valve, generally indicated by the reference numeral 310, is mounted in the body 301 by way of a gland nut 311 having a valve stem 312 threaded therein as indicated at 313. The valve stem has an intermediate portion 314 that traverses passage 302 and a conically shaped terminal end portion 315 which extends through passage 308. The conically shaped terminal end portion is smaller in diameter than the intermediate portion providing at the juncture thereof a shoulder 316 for sealingly abutting a valve seat provided at the juncture of passages 308 and 309.

The body 301 of the injection section has a further passage 320 with an inlet end 321 connected to the air pressure supply line 400 through an air flow control valve 600 and an outlet 322 located in a wall of the conically shaped passage 305.

From the foregoing it will be evident the flow passage from the reservoir 100 to passage 302 in the injection section is by way of passages 113, 203, 205, 206, 207, 204, 305, 308 and 309. The passages in which valve 208 is located and the valve therein are so arranged as to control the passage of low concentrations of contaminant to the injection stage. The air control valve 500 is a fine adjustment type valve, for example, a Hoke Ulti-Mite needle valve for controlling flow of compressed air to the reservoir. For operation in the test system, the air supply pressure must be greater than the pressure of fluid flowing through conduit 10 and the passage 302 in the injection section. Preferably the air supply pressure should be a minimum of 30 psi above the pressure of the liquid into which the injection is required. When injecting high concentrations of contaminant into fluid flowing through passage 302, the intermediate section 200 is removed and the reservoir adapter 103 connected directly to body 301 of the injection section 300. The operation is in such instance as follows. All valves are initially closed and the injection valve 310 opened momentarily to fill the reservoir to approximately one third of its capacity (200–300 cc) with liquid from line 10 and then closed. Opening air bleed valve 105 on the top of the reservoir releases the pressure in the reservoir allowing the cap 102 to be removed. Opening air flow pressure control valve 600 allows air to bubble vigorously through the liquid in the reservoir during which time a measured quantity of contaminant is added to the reservoir. The air bubbling through the liquid in the reservoir causes the contaminant to mix with the liquid. The cap is then screwed tightly onto the end of the tubular reservoir. Injection valve 310 is then opened allowing further liquid from line 10 to flow into the reservoir filling it to approximately a 500 cc level after which the injection valve is closed. The addition of the further liquid to the reservoir causes further mixing of the contaminant in the reservoir. The air bleed valve 105 is set at the required position to maintain a predetermined pressure in the reservoir necessary for injecting the slurry of liquid and contaminant particles at a selected rate into the liquid flowing in line 10. The air pressure supplied through passage 320 into the conical passage 305 bubbles up through the liquid in the reservoir maintaining a cushion of air in the reservoir above the liquid. When the pressure in the reservoir has reached the predetermined pressure, the injection valve is opened to a position to obtain the desired rate of injection of the liquid and contaminant into the main liquid stream flowing through passage 302. When all of the contaminant has been injected, the injection valve is closed. Since the reservoir mounting block 103, central section 200 and body 301 are made of plexiglass or some other transparent material one can visually observe when injection of all of the contaminant has taken place.

Figure 2:
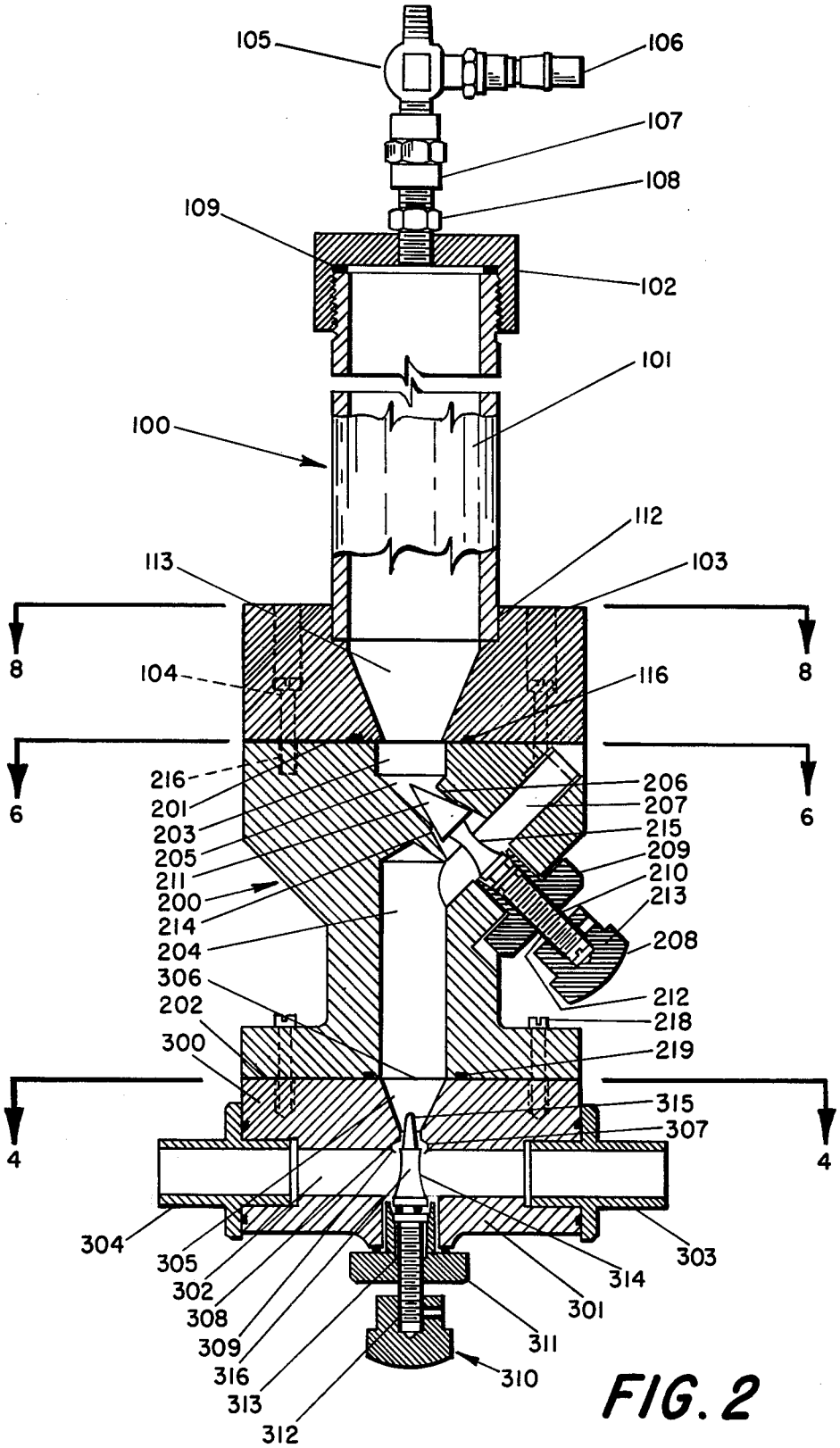
FIG. 2 is a vertical sectional view essentially of the apparatus shown in FIG. 1 but having a somewhat different external shape illustrated for one of the lower components of the apparatus.
Figure 6:
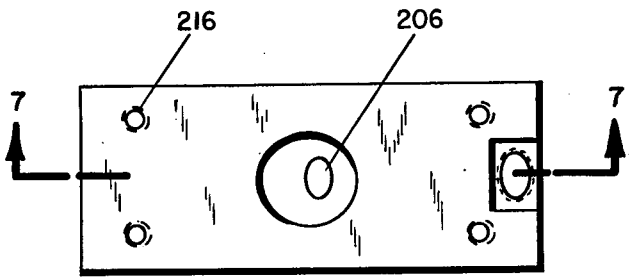
FIG. 6 is a plan view of the body of the central section of the apparatus taken essentially along line 6—6 of FIG. 2 but showing the whole body.
Figure 7:
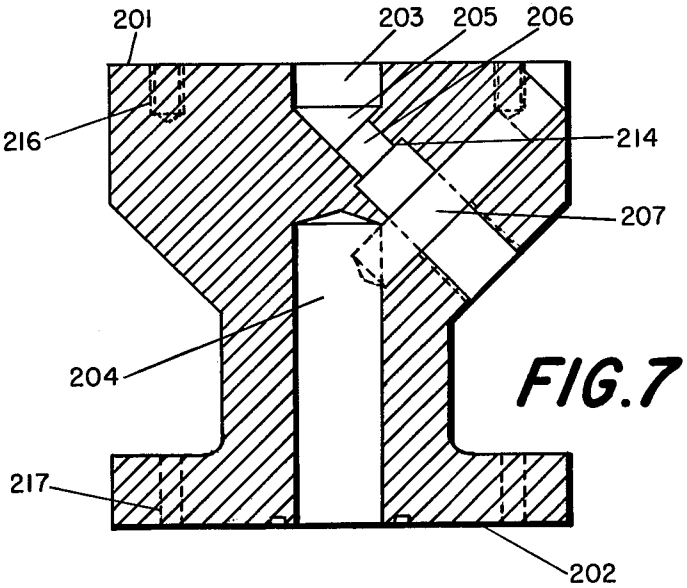
FIG. 7 is a sectional view taken along line 7—7 of FIG. 6.
Figure 3:
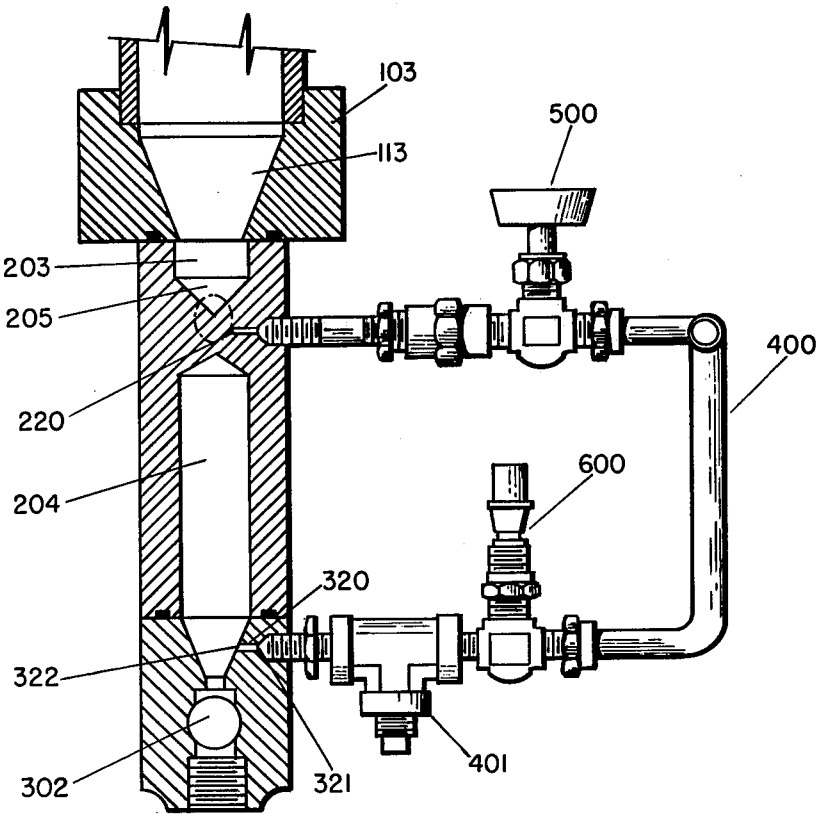
FIG. 3 is a partial sectional view taken essentially along line 3—3 of FIG. 1.
Figure 10:
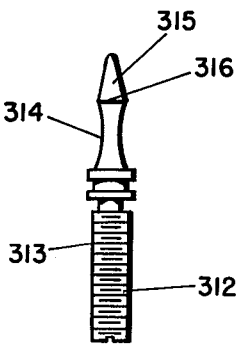
FIG. 10 is a detailed view of the injection control valve.

When injecting a low concentration of contaminant to the liquid stream flowing through conduit 10, central section 200 is interposed between the reservoir and the injection section as shown in FIG. 2. In operation, initially all valves are closed and the injection valve and the flow control valve 208 are opened to fill the reservoir to approximately one third capacity of liquid from the liquid which is flowing through passage 302 in the injection section. The air bleed valve 105 is opened as is also the air flow control valve 500 supplying air to the reservoir which bubbles up through the liquid therein. With the reservoir cap removed, the desired amount of contaminant is measured and deposited in the reservoir and the cap then screwed on tightly to close the reservoir. With the flow control valve 208 closed, the injection valve may be opened to the required position and thereafter flow control valve 208 opened to allow liquid to enter the reservoir to aid in the mixing process and fill the reservoir to approximately the 500 cc level. When the liquid has reached this level, the injection valve is closed as is also the air flow control valve 500. The air flow control valve 600 is opened and adjusted to provide the desired injection rate as determined from prior calibration. The flow control valve 208 is adjusted to the required position to allow the pressure in the reservoir to build up and which initiates the injection of the liquid and contaminant therein into the fluid flowing through conduit 10.

To obtain the most uniform and optimum mixing characteristics, the liquid, with the contaminant particles therein, should occupy about half the volume of passage 204 in the central section. This is controlled by adjusting the air flow control valve 600. When both the reservoir and passage 204 in the central section are empty, the air pressure supply is turned off and the unit is ready for cleaning as there may be a small amount of contaminant left in the apparatus as a residue after injection. The quantity of residue remaining is normally less than one percent of the total amount of contaminant injected. Before the next injection the residue in the apparatus may be removed by closing the air supply valves 500 and 600 and opening the air bleed valve 105 as well as the injection valve allowing liquid from the main conduit to fill the reservoir. When the central section is utilized, the flow control valve is also opened. When the reservoir is full, the air bleed valve of the reservoir is closed and air flow control valve 600 opened allowing air pressure to build up forcing the liquid from the reservoir back into the liquid flowing through line 10. This procedure may be repeated as many times as necessary to remove the residue from the apparatus. A by-pass filter should be installed downstream of the injector in conduit 10 to prevent unnecessary contamination from entering the test circuit during the cleaning operation. For a more thorough cleaning, the apparatus may be dismantled although this normally is not necessary.

An apparatus of the foregoing type has been constructed for test purposes to ascertain its performance characteristics and FIG. 12 shows a typical calibration graph with various valve settings for injecting a contaminant into diesel fuel at 75° F. A different calibration graph will be required for each different liquid and various temperature conditions.

Figure 1:
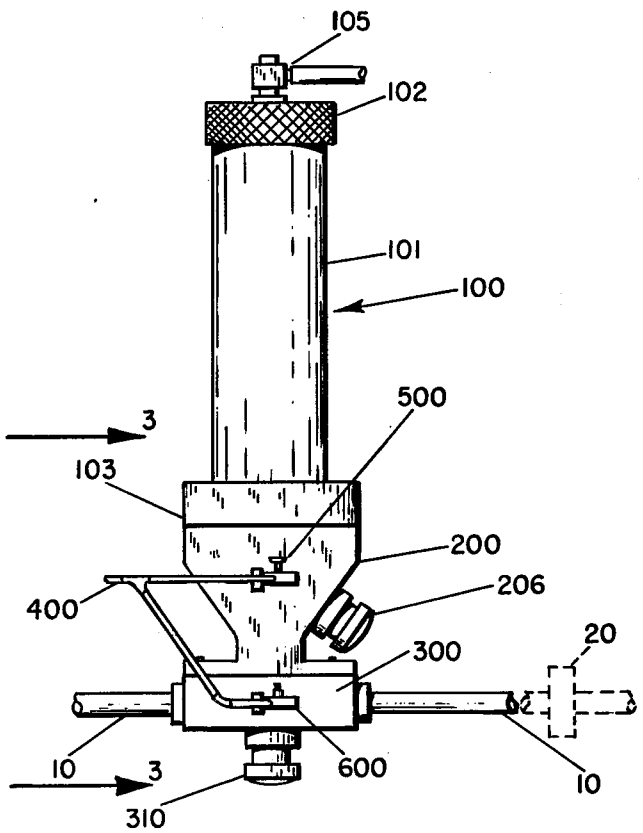
FIG. 1 is an elevational view and partial schematic of a contaminant injection apparatus constructed in accordance with the present invention connected in a test system.

With the test apparatus the repeatability of the results was very good, about 2% or less for a given set of conditions. The operating conditions for the test illustrated in the graph in FIG. 12 involved diesel oil at a pressure of 10 psig flowing in the equivalent of line 10 shown in FIG. 1 at a rate of 40 gallons per minute. The volume of fuel in the reservoir, at the start point of injection of the liquid and contaminant, was 500 milliliter and air supply pressure at 25 psig, the fuel temperature being 75° F. The contaminant selected was AC coarse test dust and the amount was 100 g. The graph illustrates injection time versus number of open turns of the air flow control valve 600 versus various number of open turns of the flow control valve 208.

The tests have illustrated the present apparatus is practical advantageously utilizing fluid control coupled with turbulent mixing to attain a satisfactory injection of solid contaminant particles into a liquid stream. The injection rate may be finely regulated and provides good repeatability for a wide range of injection rates. The contaminant injected may be a liquid, a slurry or a fine powder. The system is easily installed in any test circuit and utilizes low air pressure which is readily available and its simplicity involves minimum capital and operating costs. The system is easily maintained due to its self-cleaning capability and simple construction. The apparatus is intended primarily for injecting contaminant into low pressure and temperature liquid systems, i.e. below 50 psig and 150° F. The maximum concentration for the test apparatus is approximately 1 part solid particle : 1 part liquid by weight and the minimum concentration being about 10 ppm. The test apparatus is capable of handling a largest particle size of approximately 1 mm, with a total amount of contaminant injected in one operation being about 200 g. These limitations are a direct function of size and the apparatus may be scaled up or down as required for various purposes. Reference numeral 401 indicates a tee having a plug therein for use in cleaning purposes.

We claim:

1. An apparatus for use in controllably injecting contaminant into liquid flowing through a conduit in a liquid flow system, said apparatus comprising an injection section having a first body member with a first fluid flow path therethrough adapted to be connected in series with said conduit, a second passage in said body member reducing in cross-sectional area in a direction toward said first passage and having a restricted discharge outlet opening into said first passage, the flow path through said second passage being substantially transverse to the flow path through said first passage, an adjustable valve mounted on said body member for varying the rate of flow through said restricted discharge outlet, a thrid passage in said body member for supplying pressurized fluid to said second passage along a flow path substantially transverse to the flow path through said second passage, and a reservoir section having a second body member detachably mounted on said first body member, said reservoir section having an elongate reservoir chamber coaxial with said second passage and communicating therewith through an end portion of the reservoir chamber that gradually decreases in cross-sectional area in a direction toward said second passage, an adjustable pressure relief means for said reservoir chamber disposed at a position remote from said reduced end portion for operation when the reservoir is in an upright position, said reservoir chamber being openable and closable for introducing contaminant material therein.

2. The apparatus as defined in claim 1 wherein said reservoir chamber is a graduated cylindrical tube having a cross-sectional area at least as great as the largest cross-sectional area of said second passage.

3. The apparatus as defined in claim 2 wherein said reservoir chamber is openable and closable by a removable cover and wherein said adjustable pressure relief means comprises a valve mounted on said removable cover.

4. The apparatus as defined in claims 1, 2 or 3 wherein at least said second body member is made of a transparent material.

5. An apparatus as defined in claim 1, 2 or 3 including an intermediate section interposed in line between said injection section and said reservoir section, said intermediate section comprising a third body member detachably connected to respective ones of said first and second body members and having a passage system therethrough providing communication between said reservoir chamber and said second passage, said passage system having at least first and second passage portions communicating one with the other through a portion of restricted cross-sectional area having an adjustable flow control valve therein, said first and second portions communicating directly respectively with said reservoir chamber through the end thereof reduced cross-sectional area and said second passage, and passage means for introducing a pressurized fluid from a source of the same to the passage system at a position between said flow control valve and said reservoir chamber.

6. An apparatus as defined in claim 5 wherein said reservoir chamber, first and second portions of the passage system and said second passage are coaxial one after the other in a direction toward said first passage of the injection section.

7. The apparatus as defined in claim 1 wherein said second passage is a truncated conically shaped passage having a flow path therethrough transverse to the flow path through said second passage and wherein said third passage has a fluid flow path therethrough discharging into the second passage in a direction transverse to the flow path through said second passage.

8. The apparatus as defined in claim 1 wherein said reservoir is a separate assembly detachably mounted on another separate body member having said first, second and third passages therein.

9. The apparatus as defined in claim 1 wherein said reservoir communicates with said second passage through an intermediate passage system having a fluid flow control valve therein, said intermediate passage system providing an intermediate chamber between said fluid flow control valve and said second passage and further passage means for introducing a pressurized fluid into said intermediate passage system between said fluid flow control valve and said reservoir chamber.

* * * * *